US006237777B1

(12) United States Patent
Bierly

(10) Patent No.: US 6,237,777 B1
(45) Date of Patent: May 29, 2001

(54) DISPLAY CARTON FOR SIMULATED ARTICLE INSPECTION

(75) Inventor: Don L. Bierly, Lexington, KY (US)

(73) Assignee: Hunter Manufacturing Group, Inc., Lexington, KY (US)

( * ) Notice: Subject to any disclaimer, the term of this patent is extended or adjusted under 35 U.S.C. 154(b) by 177 days.

(21) Appl. No.: 08/856,228

(22) Filed: May 14, 1997

(51) Int. Cl.[7] ..... B65D 5/50

(52) U.S. Cl. ..... 206/758; 206/763; 206/764; 206/769; 206/232; 229/162

(58) Field of Search ..... 206/758, 763, 206/764, 765, 769, 781, 782, 303, 426, 427, 457, 776, 777, 459.5, 775; 229/116.1, 162, 120.15, 120.16; 40/312; D9/418

(56) References Cited

U.S. PATENT DOCUMENTS

| | | | | |
|---|---|---|---|---|
| D. 126,826 | * | 4/1941 | Lane | 206/457 |
| 1,670,498 | * | 5/1928 | Einson | 206/782 |
| 1,899,666 | * | 2/1933 | Buschman | 206/457 |
| 2,238,545 | * | 4/1941 | Whiley | 206/427 |
| 2,339,176 | * | 1/1944 | Lee | 206/426 |
| 2,771,986 | * | 11/1956 | Bekoff | 206/773 |
| 3,070,222 | * | 12/1962 | Jones | 206/426 |
| 4,212,391 | | 7/1980 | Schillinger . | |
| 4,603,779 | | 8/1986 | Meyers et al. . | |
| 4,736,846 | | 4/1988 | Durand . | |
| 4,875,586 | * | 10/1989 | Chaussadas | 206/427 |
| 5,145,067 | * | 9/1992 | Carver | 206/426 |
| 5,156,276 | | 10/1992 | Lebowitz . | |
| 5,485,913 | | 1/1996 | Steinfels, III . | |
| 5,579,990 | | 12/1996 | Durand . | |

FOREIGN PATENT DOCUMENTS

| | | | | |
|---|---|---|---|---|
| 1492902 | * | 4/1902 | (FR) | 206/426 |

* cited by examiner

*Primary Examiner*—Shian Luong
(74) *Attorney, Agent, or Firm*—King and Schickli, PLLC

(57) ABSTRACT

A display carton for holding glassware, compact discs or the like that allows for full, simulated inspection of the article without opening the carton. To view and touch the article(s), the prospective purchaser has limited access through individual cutout opening in the front of the carton. Although a substantial portion of the article can be observed directly, the cutouts are limited in size to aid in protecting the article within the carton. To provide the full, simulated inspection of the article to the prospective purchaser, a silhouette of the peripheral outline of the article is printed around the cutout on the front surface of the carton. A slide-out tray may also be used to secure the articles within the carton. The tray includes a fold over cover, folded pop-in dividers and a tube with recesses for securing the articles. The slide-out tray allows the articles to be easily removed from the carton, inspected, and returned to the carton.

13 Claims, 3 Drawing Sheets

DISPLAY CARTON FOR SIMULATED ARTICLE INSPECTION

TECHNICAL FIELD

This invention relates generally to a carton for holding one or more articles; and more specifically, to a display carton for holding glassware, compact disc cases and the like providing a full, simulated inspection of the article, including a substantial portion of the article itself through a cutout opening.

BACKGROUND OF THE INVENTION

Generally, display cartons for holding glassware and other articles are well known in the prior art. Most of these standard cartons are formed by making a series of folds to a paperboard blank to form a hollow interior and fixed, internal supporting retainers for holding the articles. Although the outer surfaces of these cartons often have pictures, such as photographs of the articles, along with the printed advertising material relating to the articles, the prospective purchaser has no way of direct inspection of the actual articles without opening the carton.

In some instances, a transparent sheet is used to cover an opening on one side of the carton, in which case the articles can be partially seen, but not touched. Retailers usually prohibit a potential customer from opening these cartons, since part of the closure flaps will be mutilated, thus leaving the impression for the next customer that tampering with the contents has occurred.

To attempt to overcome this shortcoming, some carton designers propose cutout openings that allow the articles to be both partially viewed and touched inside of the carton. For example, in U.S. Pat. No. 5,579,990 to Durand, cutout openings located at opposing corners of the glassware carton allow for the partial visual and tactile inspection of some of the glasses. In addition to providing a partial view of the article, the borders surrounding the cutout opening generally function as retaining walls for assisting in securing the article in the carton. However, these retaining walls also prevent a prospective purchaser from obtaining a good view of the complete article without removing it from the carton.

In addition to the retaining wall surrounding the cutout opening, the inside of the display carton has the usual fixed retainer to further assist in holding the article in the carton. Although these retainers advantageously prevent the articles from shifting during transportation, as well as during stocking and display on the retailer's shelves, the retainer has the undesirable limitation of preventing easy access for full visual/tactile inspection of the article. For example, in U.S. Pat. No. 5,156,276 to Lebowitz, a fixed retainer extends over the top of the article, and thus greatly obstructs a useful inspection of the article in the carton. This retainer is clearly designed to also prevent the article from being easily removed, fully inspected, and returned to the carton.

Some leading inventors in the field of glassware cartons have gone so far as to try to solve the problem by designing simply a glassware carrier, which design leaves more than half of the glasses fully exposed; see for example, U.S. Pat. No. 4,736,846 to Durand. As is obvious, this design is even more problematical since the glassware is very susceptible to being easily broken during handling of the carrier.

Therefore, a need is identified for an improved display carton having a cutout opening for viewing and touching an article contained within a carton, and at the same time providing full protection during handling. The carton should provide for a simulated appearance of the article that includes at least a substantial portion of the article itself being available for visual and tactile inspection. The prospective purchaser should have the impression that a full view of an article contained within the carton is provided. Furthermore, the carton needs to be adapted to allow the purchaser to easily remove the article from the carton, fully inspect the article while protecting the article, and then easily return the article to the carton. In addition, this access and inspection must be able to be accomplished without damaging the carton.

BRIEF DESCRIPTION OF THE INVENTION

Accordingly, it is a primary object of the present invention to provide a new and improved display carton allowing for full, simulated inspection, including a cutout opening for actual visual and tactile inspection of a substantial portion of the article, thereby providing a satisfying visualization of an article contained within the carton.

It is another object of the present invention to provide such a display carton having a cutout opening for actual visual/tactile inspection of the article, and including a printed silhouette extending around the border of the opening to provide the simulated appearance.

It is another object of the present invention to provide a display carton that has a slide-out tray for securing an article inside of the carton, whereby the slide-out tray may be easily removed from the carton, the article inspected, and then easily returned to the carton.

It is a further object of the present invention to provide a slide-out tray for securing an article inside of a display carton that is easily erected from a paperboard blank.

It is still another object of the present invention to provide a display carton for full, simulated inspection of an article and for a related article.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved display carton provides for a full, simulated inspection of the article or articles in the carton, including a substantial portion of the article itself through a cutout opening. In the preferred embodiment of the carton, the cutout opening is surrounded by a printed silhouette to simulate the outer periphery of the article. Thus, the article(s), which may be glassware, CD cases, or the like, advantageously can be directly viewed and touched, but at the same time, a satisfying, full visual inspection can be made up close, or from a distance.

The display carton is ideally formed from a foldable paperboard blank that is erected into a rectangular box having a hollow interior. The front panel of the carton contains one or more cutout openings. Advantageously, these cutout openings allow for the visual and tactile inspection of a substantial portion of the article while it remains secure inside of the carton. Additionally, the borders of the front panel surrounding the cutout opening act to retain the article inside the carton, thus protecting the article from damage and pilfering.

Advantageously, because the printed silhouette provides the prospective purchaser with a full, simulated view of the article, the purchase can be made with full satisfaction without necessitating the opening of the carton or the removal of the article from the carton. Ideally, the printed silhouette covers the full periphery of the article, that is an image of the top, bottom, and sides of the article, although less than the full periphery is contemplated within the broadest aspects of the invention.

According to another important feature of the invention, a slide-out tray for holding an article or articles inside of the carton is provided. Preferably, this slide-out tray is formed from a paperboard blank having a series of fold lines. To secure the articles within the carton, the slide-out tray is provided with a fold over cover having a series of folded, pop-in dividers for retaining the upper portion of the article. Additionally, the slide-out tray has a base with a series of recesses for retaining the lower portion of the article.

It will now be realized that in addition to securing the articles in the carton, the slide-out tray advantageously allows the articles to be easily and efficiently removed from the carton, inspected, and returned to the carton.

An alternative embodiment of the display carton includes a carton for holding a compact disc case or jewel box. In addition to having the cutout opening with printed silhouette, this embodiment has a series of folded, pop-in dividers formed in the front panel of the carton for holding the case in proper viewing position. A side cutout opening is also provided allowing for the spine of the case to be viewed.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention and together with the description serve to explain the principles of the invention. In the drawings.

Reference will now be made in detail to the present preferred embodiment of the invention, an example of which is illustrated in the accompanying drawings.

BEST MODE OF CARRYING OUT THE INVENTION

Figure 1:
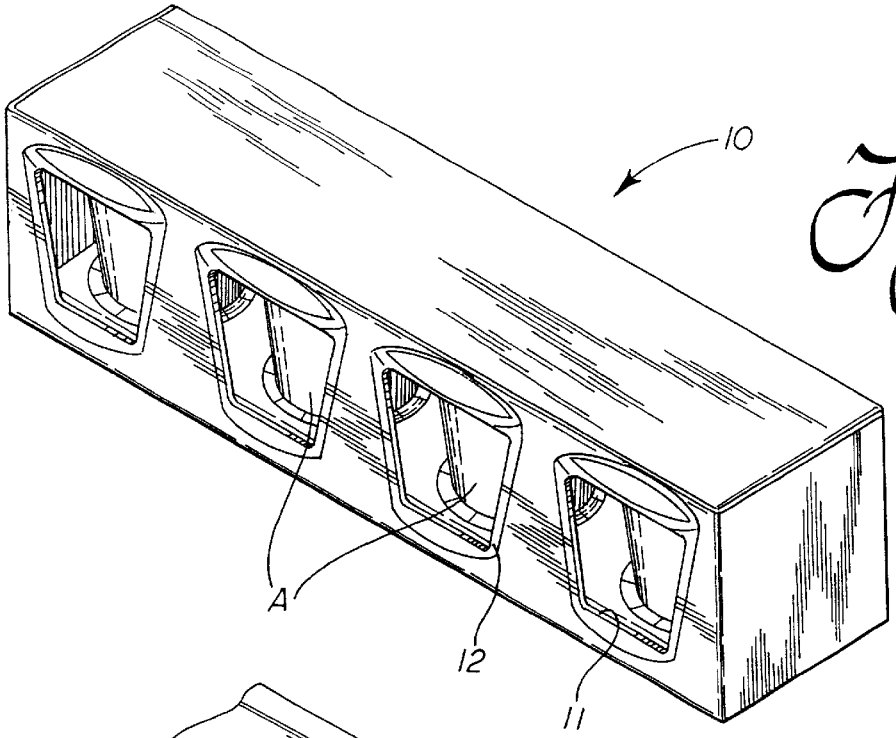
FIG. 1 is a perspective view of a preferred embodiment of the invention, in the form of a fully assembled display carton for glassware with cutout openings, each opening surrounded by the printed silhouette, and a slide-out tray in the carton supporting the glassware.

Reference is now made to FIG. 1 showing a preferred embodiment of the invention in the form of a fully assembled display carton 10, which is rectangular in shape and has four panels providing the top, front, bottom, and back sides, all defining a hollow interior. As can be seen, the front panel has a series of cutout openings 11 allowing for tactile and visual inspection of an article A or articles, such as the glassware illustrated, contained within the carton 10. These cutout openings are limited in size, but generally in the shape of the article A, leaving a portion of the panel intact for retaining and protecting said article. Of course, the size, shape and location of the cutout openings depend on the particular articles, as well as the number of articles that are contained within the carton.

Figure 6:
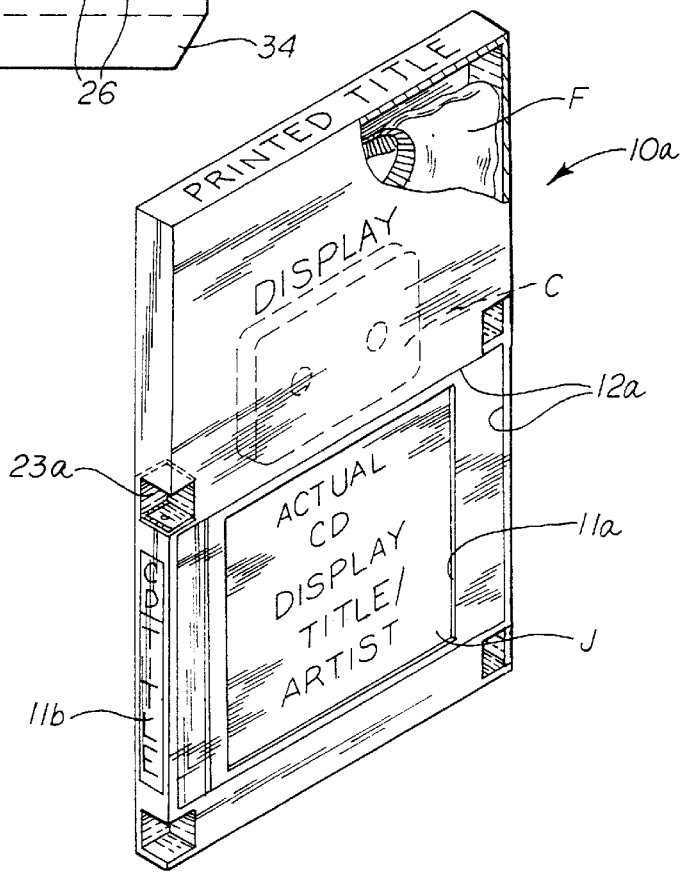
FIG. 6 is a perspective view of an alternate embodiment showing a display carton for holding a compact disc case or jewel box with a cutout opening surrounded by a printed silhouette and folded, pop-in dividers for retaining the case in position.

While glassware is illustrated as the article A in the preferred embodiment of FIGS. 1–5 to demonstrate the salient principles of the present invention, other articles, such as the CD case or jewel box J of the alternative embodiment of FIG. 6, are contemplated. It is obvious for example that marketing of any other collectable items, including drinking steins, mugs and the like, can particularly benefit from use of this carton 10.

Each cutout opening is surrounded by a printed silhouette 12. As can be appreciated, this silhouette is printed on the outside of the carton 10 and ideally depicts the portion of the article A that is blocked by the border surrounding the cutout openings. Advantageously, the printed silhouette 12 allows the prospective purchaser to visualize the article A in full, simulated form, but with a substantial portion being the article itself, without opening the carton 10.

The display carton 10 has left and right end panels that ideally pivot from the outer edge of the front panel. These end panels fold along vertical fold lines, thereby allowing the hollow interior portion of the carton to be accessed. The end panels are closed by a locking tab arrangement.

Figure 1A:
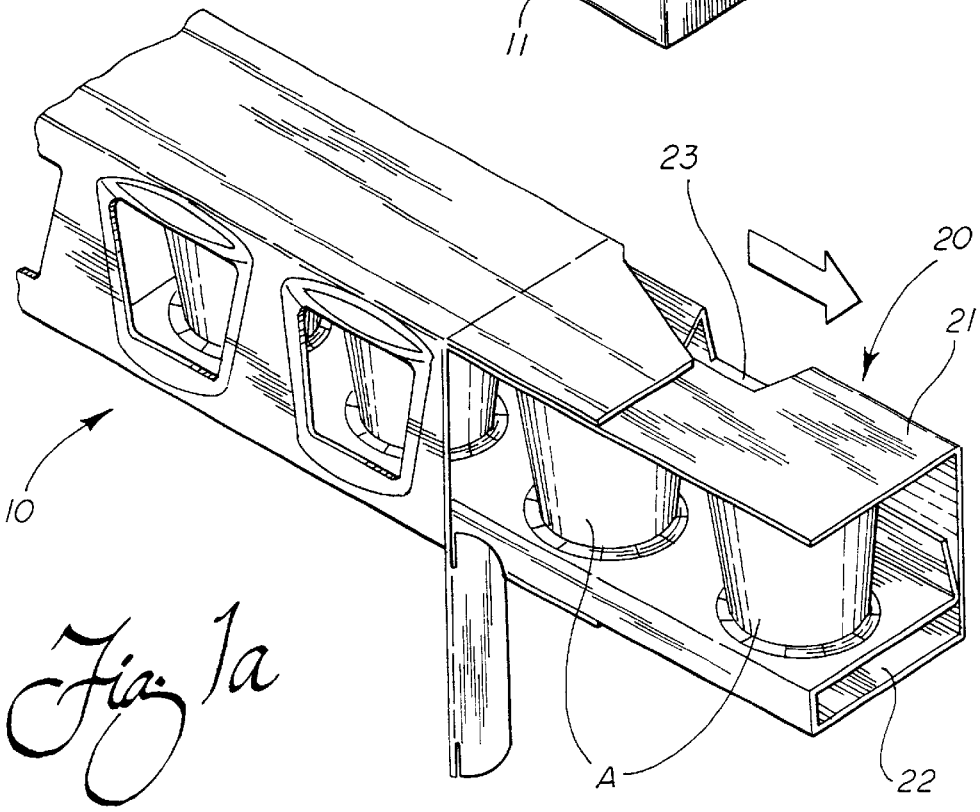
FIG. 1*a* is a similar perspective, but partial view that is cut away for saving space, and showing the carton of FIG. 1 with the slide-out tray being removed from the splay carton to provide full access to the glassware.

As can be seen in FIG. 1*a*, a slide-out tray 20 is also provided for securely holding the article(s) A in the display carton 10. The slide-out tray is ideally formed from a generally planar, rectangular and foldable paperboard blank B (see FIG. 2). This slide-out tray 20 has a fold over cover 21 for protecting the top of the articles and a base tube 22 for securing the bottom of the articles. In addition to the securing function, the cover 21 and base tube 22 also act to protect the articles from damaging each other during handling. The outside planar surfaces of the fold over cover 21 and the tube 22 are not attached to the carton 10, and thus advantageously allow the tray 20 to freely slide in and out of the hollow interior of the display carton 10, thereby facilitating the easy removal, full inspection and return.

Figure 2:
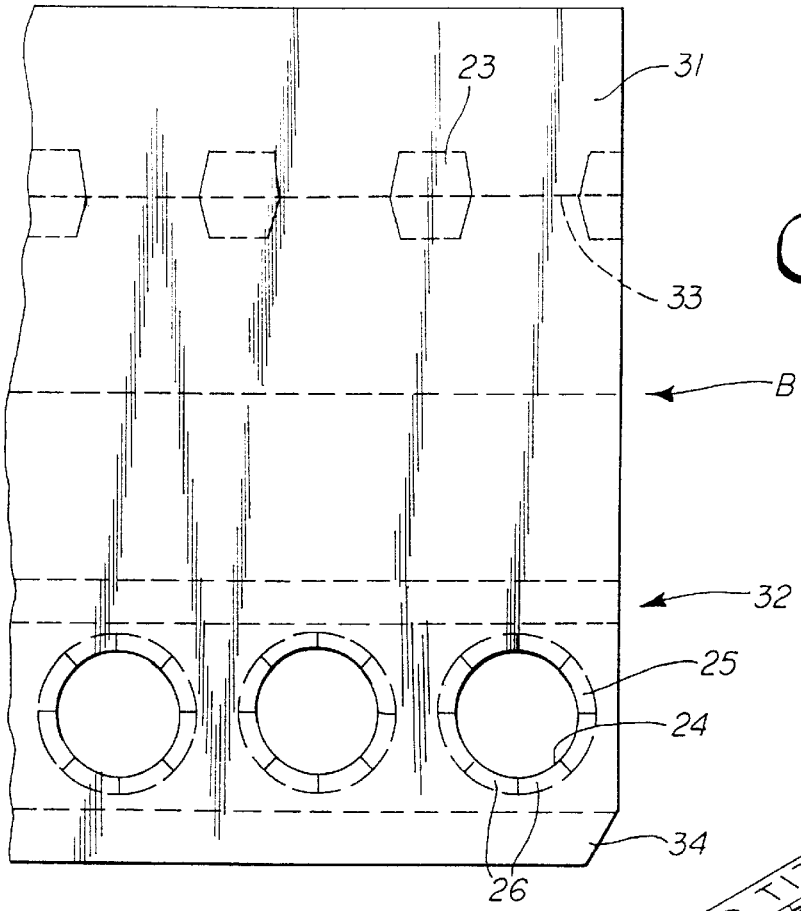
FIG. 2 is partial plan view of the blank used to form the slide-out tray.
Figure 3:
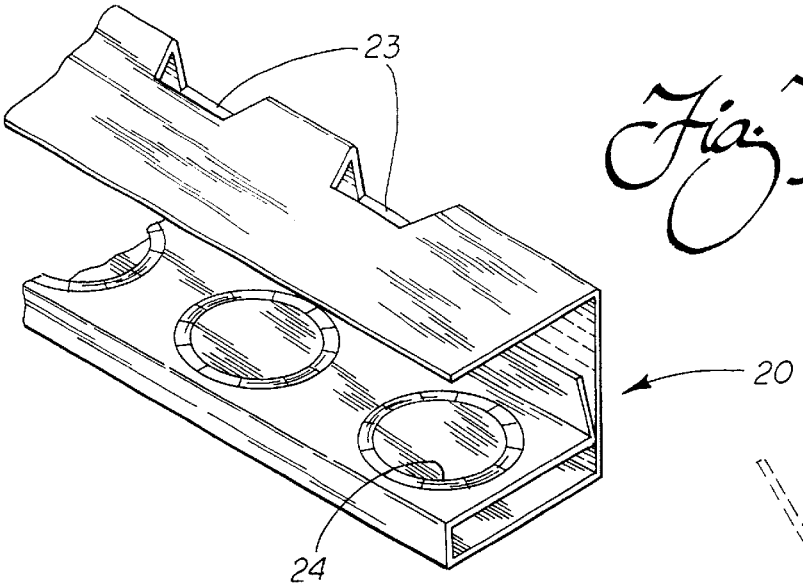
FIG. 3 is a partial perspective view of the slide-out tray showing the fold over cover with folded, pop-in dividers for retaining the upper portion of the article(s) and the base with recesses for securing the lower portion of the article.
Figure 4:
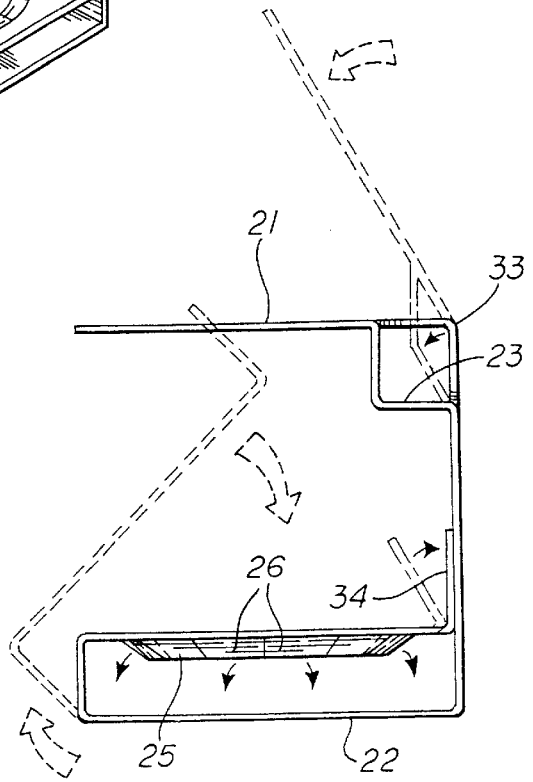
FIG. 4 is a cross-section view of the slide-out tray showing the sequence of erecting the tray from a paperboard blank.

More specifically, FIG. 3 shows the slide-out tray 20 separated from the display carton 10. Straddling the fold over cover 21 and the back panel are folded, pop-in dividers 23 formed by punching between spaced slits (see FIG. 2). These folded dividers secure the top portion of the article A in the slide-out tray. As can be readily appreciated, the size and specific shape of the folded dividers 23 depend on the dimensions of the article A being packaged.

A recess 24 in the base tube 22 of the slide-out tray 20 is provided to secure the bottom portion of each article A. This recess is of course sized and shaped according to the dimensions of the article. For glassware, the recess is circular and has an annular series of sectioned arcuate tabs 25 forming a flexible securing ring 26. These tabs are connected around the circumference of the recess along arcuate fold lines. Upon insertion of the bottom of the article into the recess, the tabs 25 form the securing ring 26 to the exact size needed. After insertion, the flexible securing ring 26 presses outwardly against the bottom edge of the article A, thereby centering and securing the article in the slide-out tray 20.

The showing in FIG. 2 specifically provides the layout of the foldable blank B of the slide-out tray 20 prior to erection. As mentioned above, spanning the cover 21 and back panel are the spaced slits that form the folded, pop-in dividers 23. Preferably, these slits form an acute angle at their mid-point at the horizontal fold line 33 that defines the cover 31 and the back panel. Introducing an acute angle into the slits creates folded dividers that produce tabs pivoted together in the shape of two trapezoids mirrored about the horizontal fold line 33. As can be seen, this tab shape aids in retaining certain types of articles A, including the glassware, in the slide-out tray 20 since the angle of the retaining edge mates with the taper of the side of the glass (see dashed line outline of FIG. 5). As can be appreciated, the length and angularity of the slits generally depends on the dimensions of the article to be secured and separated.

A series of horizontal fold lines are also located in base portion 32 of the blank B. These fold lines demarcate a series of panels that, upon folding of the blank, form a rectangular tube 22. As can be seen, the tube 22 includes the recess(es) 24 with the sectioned arcuate tabs 25 of the securing ring 26. As with the folded dividers, the number and dimensions of the recesses depends on the number and dimensions of the articles to be secured and displayed.

A tab 34 extends from the lowermost horizontal fold line in the blank B that forms the slide-out tray 20. After making the appropriate folds in the blank, the face of the tab 34 is preferably glued to the inside of the back panel, thereby forming the rectangular base tube 22.

Ideally, the blank B for the slide-out tray 20 is made of foldable paperboard, thereby allowing for easy construction and erection. As can be readily appreciated from viewing FIG. 4, during the erection operation, the cover 21 is folded along the horizontal fold line 33. The back panel of the tray and the tube 22 is then folded along the four additional fold lines (see the dashed line to full line outlines and action arrows). The folded dividers 23 are popped in by finger pressure (see action arrow). Each divider 23 moves through its over-center position as this is done, thus causing them to stay (see full line outline). The angled edges of the dividers 23 mate with the tapered sides of the glasses toward the rear, as can be visualized in FIG. 5.

Preferably, a group of similarly shaped and sized articles, such as jigger size collector glasses/articles A, are inserted into the slide-out tray 20. For purposes of this description, the display carton 10 and slide-out tray 20 are formed to accommodate a set of four glasses, but any other number is within the teaching of this invention. Each glass is inserted in the selected recess 24 in the tube 22. The fold over cover 21 provides protection by covering the open end of the glasses. In this position, the folded dividers 23 extend inwardly between the glasses and against the sides for separation, as explained above. After the glasses are thus secured in the tray 20, it slides into the display carton 10 through either end panel. The panel is then securably closed and the assembly of the display carton 10 is complete.

Figure 5:
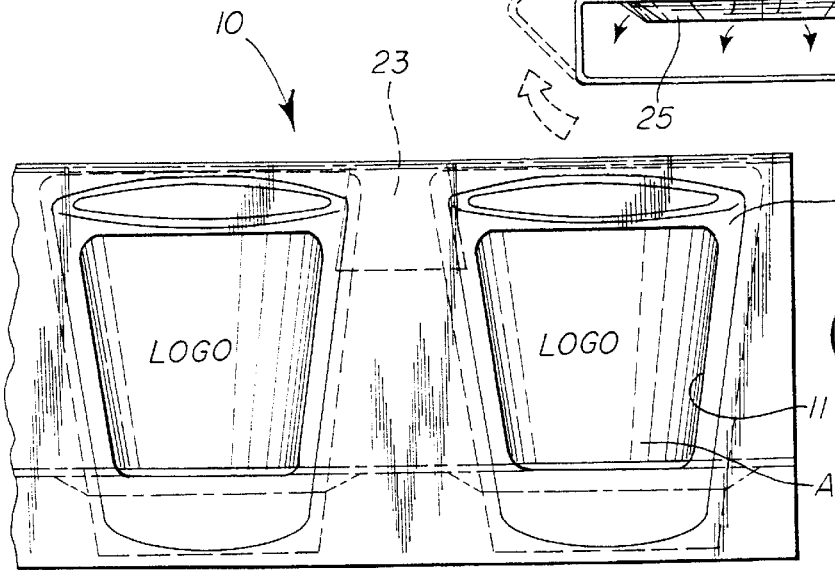
FIG. 5 is an enlarged, partial front view showing the glassware in the display carton surrounded by a printed silhouette.

As can be seen in FIG. 5, a logo or display on the front portion of the glass/article A is easily viewed through the corresponding cutout opening 11 in the display carton 10. The borders surrounding the cutout opening provide support, but prevent the prospective purchaser from obtaining a full view of the glasses. In order to provide a full, simulated visualization of the glasses, the printed silhouette 12 surrounds the cutout opening 11 and depicts the top, sides, and bottom of the glass. As can be appreciated, not only is good visibility now given, but the prospective purchaser can also touch and feel the glass through the cutout opening 11 in a manner sufficient to fully judge its quality. Where the glass has been screen-printed with a logo and/or design, its quality and completeness can be judged by feeling the raised surface of the kiln-dried ink. At the same time, the glass/article A remains protected from damage.

If the prospective purchaser wishes to inspect the glasses in more detail, a salesperson simply opens the end panel of the carton 10 to easily remove the slide-out tray 20. The prospective purchaser may then conduct a more complete visual and tactile inspection the articles. After this inspection, the articles A are easily returned to the recesses 24 in the slide-out tray 20, the fold over cover 21 is positioned over the upper portion of the glasses, and the dividers 23 are popped in the retaining position. The tray 20 is then easily slid back into the display carton 10 and the end panel closed. Of course, at home the purchaser/owner can keep the collection in the carton 10, using the same process for periodically removing the articles for inspection, such as for sharing with other fans and friends.

An alternate embodiment of the current invention holds a CD case/jewel box/article J for a compact disc or the like, and is shown in FIG. 6. The display carton 10a has a cutout opening 11*a* through the front panel allowing for the direct visual inspection of the face of the jacket of the compact disc through the plastic cover of the jewel box/article J. As can be seen, this cutout opening 11*a* is sized to allow for a substantial portion of the compact disc jacket to be seen for identification of the title and artist. The border around the opening 11*a* holds the jewel box J in the carton 10*a*.

A printed silhouette 12*a* of the outer periphery, or a portion thereof, of the jewel box/article J covered by the border left by the cutout opening 11*a*, is provided according to the present invention. This printed silhouette 12*a* shows a simulated outline of the front so that the jewel box J appears in a full, simulated form, and thus one that is pleasing to the prospective purchaser. The visualization of the purchaser includes a substantial portion of the actual CD jacket, with its attractively printed design and information. In other words, as can be readily appreciated, this silhouette 12*a* allows a prospective purchaser to fully visualize the jewel box/article J in simulation without opening the carton 10*a*.

Additionally, a similar cut-out opening (not shown) may be provided on the rear side of the display carton 10*a*. Of course, this arrangement allows the prospective purchaser to view the back of the compact disc jacket J. In the case of a compact disc containing music, this allows the prospective purchaser to view the song titles. A printed silhouette of the outline of the jewel box is also provided on the back when this modification is used.

The display carton has folded pop-in dividers 23*a* located in each quadrant of the side and front panel of the display carton. These dividers define a hollow space at the top and/or the bottom of the carton 10*a*. These are analogous to the folded dividers 23 in the preferred embodiment, and similarly act to hold the jewel box J centered in the display carton. The extended display carton 1O*a* as illustrated advantageously protects against pilfering due to its increased size as compared to the basic size of the jewel box J. Also, by increasing the inside volume of the carton 10*a*, other article(s), such as a cassette tape C of the same music, a folded artist fan T-shirt F or the like, can thus be packaged with the CD. Additional display/advertising/title space is provided on the outside in the extended area.

In addition to the cutout opening 11*a* located on the front panel, the display carton 1O*a* also has a side cutout opening 11*b* that allows the spine of the jewel box J to be viewed by a prospective purchaser.

In summary, it will be realized that the results and advantages of the present invention are to provide a display carton 10, 10*a* allowing for the full visualization an article A/J without necessitating the opening of the carton. A cutout opening 11, 11*a* allows for the visual and tactile inspection of the article. To provide a full, simulated visualization of the article A/J, a silhouette 12, 12*a* showing the peripheral outline is printed on the border surrounding the cutout opening (see FIGS. 1 and 6). A related article C/F can be packaged with the primary article A/J as another feature of the present invention.

A slide-out tray 20 is also provided in the preferred FIG. 1 embodiment to secure the articles/glassware A inside of the carton 10. The articles A are inserted into recesses 24 in the base portion 22 of a slide-out tray 20 and a fold over cover 21 with folded, pop-in dividers 23 protect the articles in the tray. The tray 20 is slidably removed or inserted through a end panel in the display carton (see FIG. 1*a*). This slide-out tray 21 allows the articles A to be easily withdrawn from the carton 10, inspected, and returned. A foldable paperboard blank B is used to form the slide-out tray 20 in a unique manner (see FIG. 4).

The foregoing description of a preferred and an alternate embodiment of the invention have been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A display carton for holding at least one article, said display carton being formed by a foldable blank, comprising:

a plurality of panels forming a hollow interior of said carton upon erection of said blank to receive said article; and at least one panel forming a face of the carton having a cutout opening allowing for the partial visual and tactile inspection of said article, said cutout opening being surrounded by a printed silhouette of said article on said face;

the combined visual apperance of the article through said opening and said silhouette providing a substantially full visualization of the article;

whereby said article may be inspected and fully visualized by simulation without opening said carton.

2. The display carton of claim 1, including a slide-out tray for holding said article in said display carton.

3. The display carton of claim 2, wherein the slide-out tray for holding said article in said display carton is formed by a foldable blank, comprising:

a fold over cover having at least two folded dividers for securing an upper portion of said article in said slide-out tray;

a tube having a recess for holding a lower portion of said article in said slide-out tray;

whereby the article may be secured in said slide-out tray and easily inserted and removed with respect to said display carton.

4. The display carton of claim 3, wherein is provided a folded divider formed from spaced slits spanning a fold line that allow said divider to pop-in for securing the upper portion of said article.

5. The display carton of claim 3, wherein said recess has a plurality of arcuate tabs extending inwardly forming a flexible securing ring for securing the lower portion of said article.

6. The display carton of claim 4, wherein is provided a plurality of folded pop-in dividers formed to engage the opposite sides of the upper portion of said article.

7. The display carton of claim 1, wherein at least one of said panels adjacent to said panel having said cutout opening has a side cutout opening;

whereby visual inspection of the side of said article is provided.

8. The display carton of claim 1, wherein is provided a folded divider formed from spaced slits spanning a fold line that allow said divider to pop-in action for securing a portion of said article.

9. The display carton of claim 8, wherein is further provided a hollow interior portion separate from said article and defined by said divider, and a related article in said interior portion.

10. The display carton of claim 9, wherein said article is a CD case and said related article is a T-shirt.

11. The display carton of claim 1, wherein said article is glassware.

12. The display carton of claim 11, wherein is provided a plurality of glasses in said carton, a cutout opening and silhouette in said panel for each glass.

13. The display carton of claim 12, wherein is provided a tray for said glasses having folded dividers extending between adjacent glasses;

said dividers being formed from spaced slits spanning a fold line that allow said glasses to pop-in action for securing a portion of said article;

each of said dividers being formed with an acute angle at said fold line to provide matching trapezoidal tabs, the retaining edge of the operative tab extending at an angle to mate with the taper of the glass.

* * * * *